US005240442A

United States Patent [19]

Locati et al.

[11] Patent Number: 5,240,442

[45] Date of Patent: Aug. 31, 1993

[54] ELECTRICAL CONNECTOR WITH POSTS HAVING IMPROVED TIP GEOMETRY

[75] Inventors: Ronald P. Locati, Harrisburg, Pa.; James H. Messick, Gastonia; Leonard J. Myers, Kings Moutain, both of N.C.

[73] Assignee: AMP Incorporated, Harrisburg, Pa.

[21] Appl. No.: 918,112

[22] Filed: Jul. 21, 1992

Related U.S. Application Data

[63] Continuation of Ser. No. 703,433, May 17, 1991, abandoned.

[51] Int. Cl.[5] ..... H01R 13/04; H01R 13/41

[52] U.S. Cl. ..... 439/884; 439/692; 439/733

[58] Field of Search ..... 439/884, 891, 888, 890, 439/692, 733

[56] References Cited

U.S. PATENT DOCUMENTS

| | | | |
|---|---|---|---|
| 735,839 | 8/1903 | Stiles | 439/851 |
| 4,090,772 | 5/1978 | Goodman | 439/686 |
| 4,395,087 | 7/1983 | Gorre et al. | 439/885 |
| 4,464,007 | 8/1984 | Parmer | 439/692 |
| 4,557,549 | 12/1985 | Whitney | 439/638 |
| 4,679,890 | 7/1987 | Fineblum | 439/884 |
| 4,715,833 | 12/1987 | Mobley et al. | 439/834 |
| 4,734,041 | 3/1988 | Bruchmann et al. | 439/637 |
| 4,900,278 | 2/1990 | Yamada et al. | 439/857 |
| 4,909,746 | 3/1990 | Scholz | 439/82 |
| 4,913,678 | 4/1990 | Avellino et al. | 439/879 |
| 5,083,928 | 1/1992 | Aikens et al. | 439/82 |
| 5,108,316 | 4/1992 | Yamada et al. | 439/884 |
| 5,122,075 | 6/1992 | Kile | 439/554 |

FOREIGN PATENT DOCUMENTS

| | | | |
|---|---|---|---|
| 1319115 | 6/1987 | U.S.S.R. | 439/884 |

OTHER PUBLICATIONS

AMP Drawing D-111438.
AMP Drawing D-102129.

*Primary Examiner*—Gary F. Paumen
*Attorney, Agent, or Firm*—David L. Smith; Anton P. Ness

[57] ABSTRACT

An electrical connector includes a connector body and an array of posts extending out at least one side of the connector body. Each of the posts defines a tip and two opposed pairs of post faces that intersect at edges extending along the post. The tip defines four tip faces which converge toward a tip nose, and each tip face is aligned with a respective one of the post faces. Each of the tip faces is convex outwardly, and the edges between the post faces adjacent the tip are curved with a radius of curvature greater than about 0.005 inches. The electrical connector is assembled by press fitting the posts through pre-formed through holes, and the tip geometry reduces skiving of material out of the through hole as well as assembly forces.

12 Claims, 4 Drawing Sheets

ELECTRICAL CONNECTOR WITH POSTS HAVING IMPROVED TIP GEOMETRY

This application is a continuation of application Ser. No. 07/703,433 filed May 17, 1991, now abandoned.

BACKGROUND OF THE INVENTION

This invention relates to electrical connectors of the type having a connector body and a plurality of posts extending out of at least one side of the connector body. In particular, this invention relates to an improved tip geometry for such posts.

In the past, posts have been press fit into connector bodies such as pin headers. Pin headers often include either shrouded or shroudless plastic bodies which define preformed through holes into which the posts are press fit for retention in order to form a header assembly. The dimensions of the through holes and the posts are selected such that the corners of the posts interfere with the through holes, thereby retaining the posts in the connector body by a force fit.

In the past, problems have arisen during assembly of posts into such connector bodies. The assembly force required to push a post through a through hole may be undesirably high, and longer posts have experienced buckling due to excessively high assembly forces. Cracking of the plastic body of the connector has also occurred due to large interference forces, which may result in broken shrouds or loose posts. Additionally, plastic material may be skived or driven out of the through hole, accumulating on the tip of the post as it is pushed through the through hole. Such plastic material tends to accumulate on the post tip proper, and can lead to undesirable side effects when soldering the header assembly to a printed circuit board. Poor solder joints have been experienced.

SUMMARY OF THE INVENTION

The presentinvention is directed to a tip geometry that reduces or eliminates the problems described above and that, in the preferred embodiments described below, meets the following objectives:

(1) to reduce or eliminate the amount of plastic that is transferred to the tip of the post as the post is inserted into the connector body;

(2) to reduce the post assembly forces required to assemble the post in the connector body, thereby reducing or eliminating post buckling;

(3) to reduce the circumferential stresses on the through hole of the post body and to spread them more evenly, thereby reducing or eliminating breakage of the connector body;

(4) to provide better receptacle engagement surfaces on the mating end of the post, opposed to the solder end, thereby improving the feel of connector mating by reducing roughness and peak mating forces.

According to a first aspect of this invention, an electrical connector of the type described above is provided with posts having tips which define four tip faces converging toward a tip nose, wherein each tip face is aligned with a respective post face. At least one of the tip faces is convex outwardly, and the edges between the post faces adjacent the tip are curved with a radius of curvature greater than about one-fifth the maximum face to face dimension between opposed post faces. This tip geometry has been found to provide acceptably low insertion forces, reduced housing breakage, reduced skiving of the through hole, and reduced accumulation of plastic on the tip of the post.

According to a second aspect of this invention, an electrical connector of the type described above is provided with posts having tips, each of which defines four tip faces which converge toward a tip nose. Each of the tip faces is aligned with a respective post face, and at least one intermediate surface is provided which converges toward the tip nose. Each of the intermediate surfaces is interposed between two tip faces to reduce insertion forces associated with insertion of the post into the connector body.

This invention is also directed to a method of assembling an electrical connector utilizing connector bodies and posts as described above. According to this aspect of the invention, posts of the type described above are press fit into through holes of the connector body by passing tips having the geometries defined above through the through holes. These tips reduce skiving of the connector body by the posts, and thereby improve the finished product.

DETAILED DESCRIPTION OF THE PREFERRED EMBODIMENTS

Figure 1:
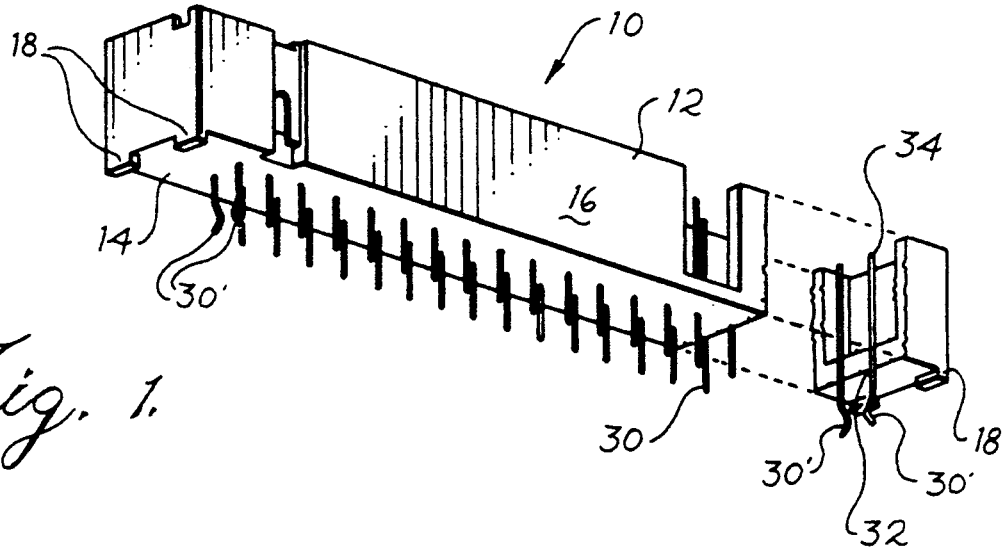
FIG. 1 is a perspective view of a shrouded header assembly which incorporates a presently preferred embodiment of this invention.

Turning now to the drawings, FIG. 1 shows a general view of an electrical connector 10 which incorporates a presently preferred embodiment of this invention. The electrical connector 10 as shown is a header which comprises a connector body 12 molded of a suitable plastic material. The body 12 includes a base 14 and integrally molded side walls 16 and standoffs 18. Rows of through holes are preformed in the base 14 during the molding operation.

Figure 2:
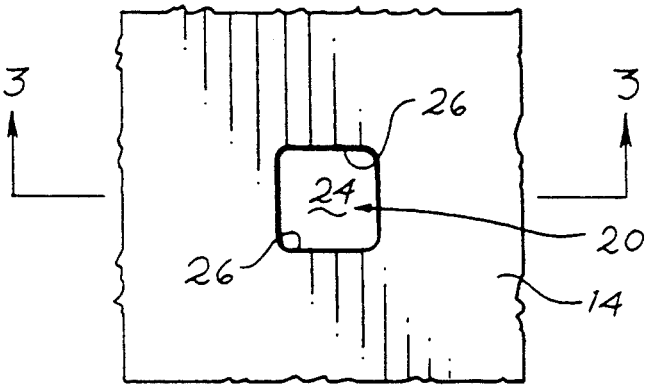
FIG. 2 is a top view of one of the through holes formed in the connector body of FIG. 1.
Figure 3:
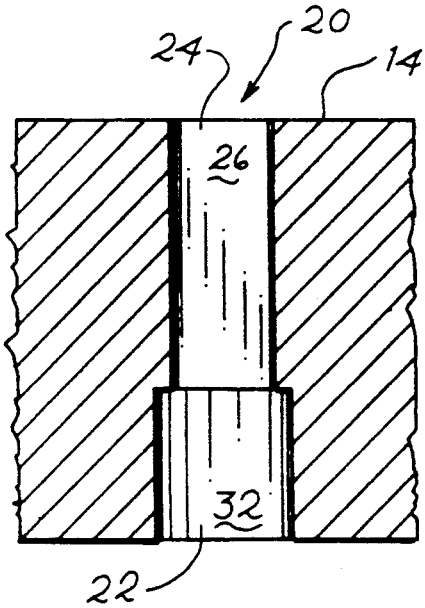
FIG. 3 is a cross sectional view taken along line 3—3 of FIG. 2.

FIGS. 2 and 3 show further details of one of the through holes 20 of the base 14, which includes a round portion 22 and an out-of-round portion 24 that includes two pairs of opposed faces 26. Preferably, each through hole 20 is formed with a single core pin that forms both the round portion 22 and the out-of-round portion 24, thereby eliminating any internal mating lines (and possible misalignment) within the through hole 20.

Figure 6:
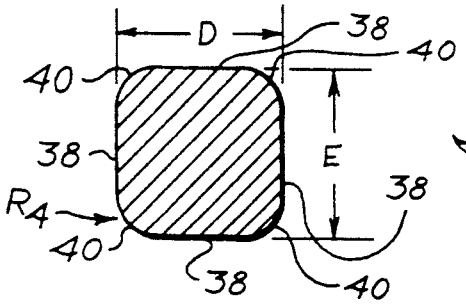
FIG. 6 is a cross-sectional view taken along line 6—6 of FIG. 4.
Figure 5:
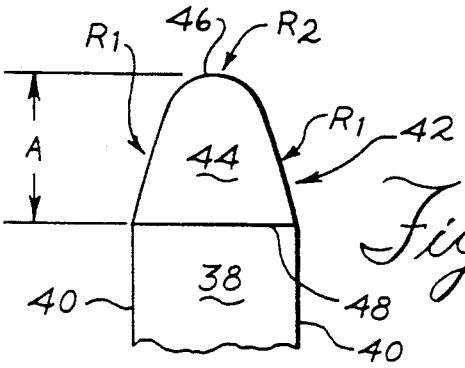
FIG. 5 is an enlarged view of the encircled region 5 of FIG. 4.
Figure 4:
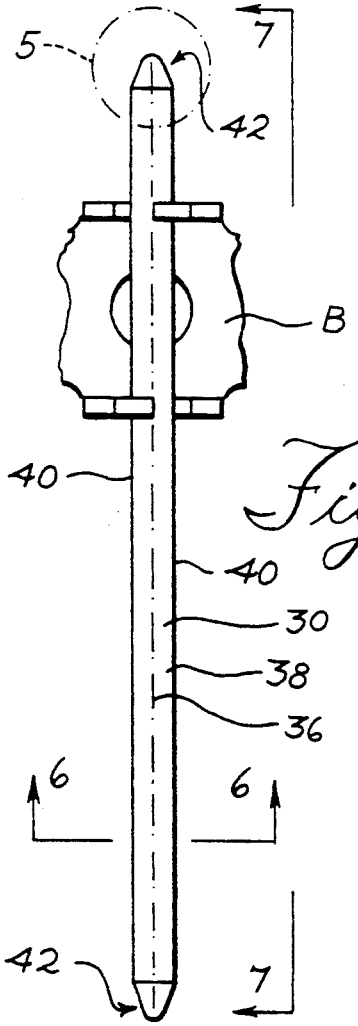
FIG. 4 is a front view of one of the posts of the connector of FIG. 1, mounted in a bandolier prior to insertion into the connector.
Figure 7:
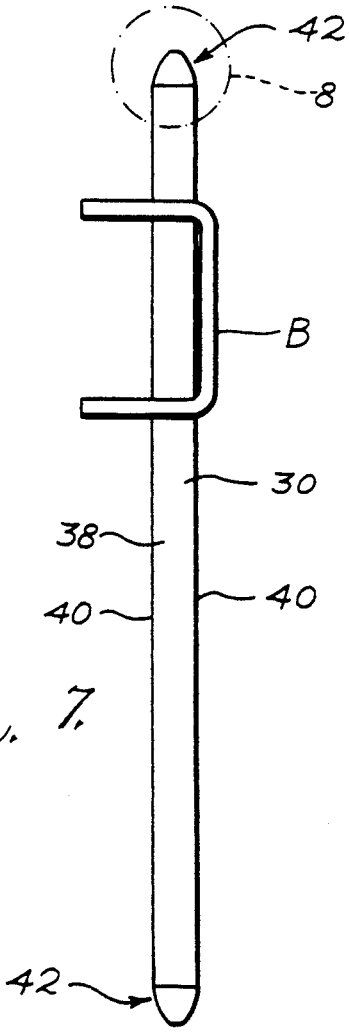
FIG. 7 is a side view taken along line 7—7 of FIG. 4.

As shown in FIG. 1, the electrical connector 10 also includes an array of posts 30, 30'. Each of the posts 30, 30' defines a first end 32 and an opposed second end 34. The first ends 32 are adapted to be inserted into through holes of a printed circuit board while the second ends 34 are adapted to mate with a mating connector (not shown). In the connector 10, the four corner posts 30' are provided with a retention feature as described below. As shown in FIGS. 4, 6 and 7, each of the posts 30 defines a cross-section which comprises two pairs of opposed post faces 38 that intersect at post edges 40 extending parallel to the centerline 36. As shown in FIG. 6, each of the post edges 40 is curved with a radius of curvature which is at least about one fifth of the maximum face to face dimension. In this particular embodiment, the maximum face to face dimension is about 0.025 inches and the radius of curvature is at least about 0.005 inches. FIGS. 4 and 5 show one of the posts 30 mounted in a bandolier B which is used to position and retain the posts 30 for forming, plating and press fit operations in the conventional manner.

Each end of the posts 30, 30' defines a tip 42 which is shaped to provide the advantages described above. The features of the tip 42 described below facilitate insertion of the tip 42 into the through hole 20 and provide improved mating between the mating end and the socket of a mating connector (not shown).

In particular, as shown in FIGS. 5, 8, 9 and 10, each tip 42 defines four converging tip faces 44 which converge from the body of the post 30 toward a nose 46. The nose 46 may be flat or radiused as desired. In this embodiment each of the tip faces 44 is shaped as a section of a cylinder and is convex outwardly with a radius of curvature that is preferably greater than the maximum face to face dimension of the post 30. Each of the tip faces 44 is aligned with a respective one of the post faces 38 and is joined thereto at a tip-to-body edge 48. Because of the convexity of the tip faces 44, there is a smooth transition between each of the tip faces 44 and the aligned post face 38.

Figure 9:
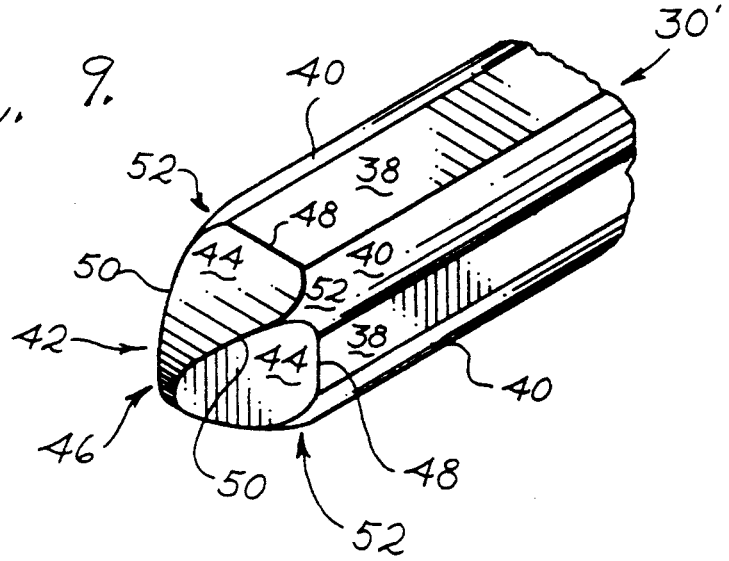
FIG. 9 is a perspective view of the tip geometry of one of the pins of FIGS. 5 and 7.
Figure 10:
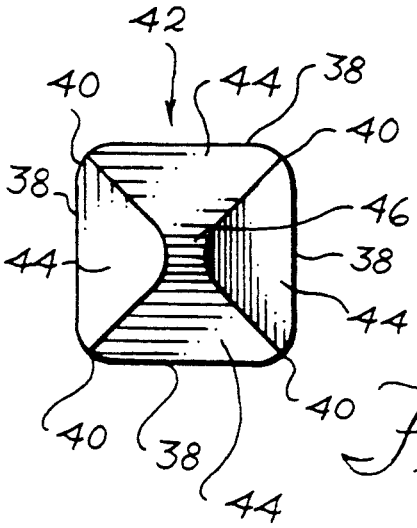
FIG. 10 is an end view of the tip of the FIG. 9.

As best shown in FIGS. 9 and 10, adjacent ones of the tip faces 44 intersect at tip edges 50 which are convex outwardly and which intersect the radiused post edges 40 at tip-to-body transition corners 52. In this regard, the convexly shaped tip edges 50 cooperate with the radiused post edges 40 to provide a smooth transition and to substantially eliminate protruding corners that might tend to skive the through hole 20 of the body 12 during assembly.

Figure 11:
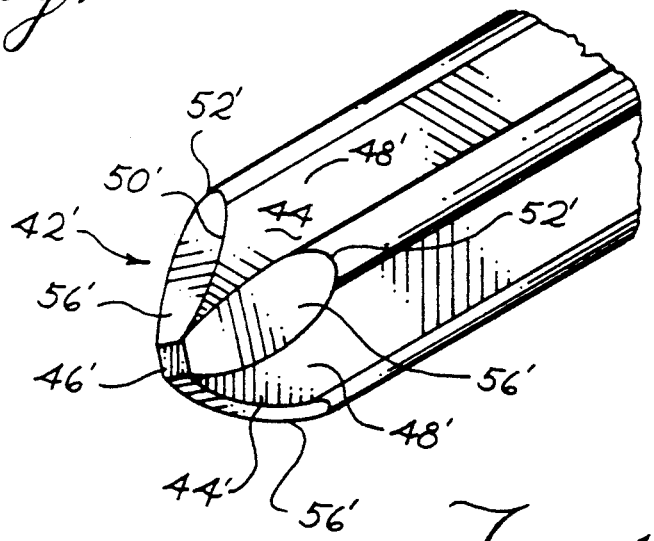
FIG. 11 is a perspective view of an alternate tip geometry suitable for use with the connector of FIG. 1.

Turning now to FIGS. 10 and 11, an alternate geometry for the tip 42' includes tip faces 44' substantially as described above which meet at a nose 46'. In this alternate embodiment intermediate surfaces 56' are provided which taper toward the nose 46'. Each of the intermediate surfaces 56' is interposed between two adjacent tip faces 44' such that the intermediate surfaces 56' are rotated by 45 degrees with respect to the tip faces 44'. In this embodiment the tip edges 50' curve inwardly toward the tip faces 44'.

The intermediate surfaces 56' provide a number of advantages. First, they reduce the prominence of the tip-to-body, transition corners 52', thereby reducing skiving problems as described below. Furthermore, because the tip edges 50' curve inwardly toward the tip faces 44', debris tends to be wiped away to the outside of the tip 42' during mating. Furthermore, the shape of the tip faces 44' allows high pressure cleaning of a mating receptacle during mating. In alternative embodiments the tip faces 44' and the intermediate surfaces 56' may be all convex, all planar, or some may be convex and some planar.

In order to assemble the electrical connector 10 the posts 30 are press fit into the through holes 20 of the body 12, by passing the tips 42, 42' through the through holes 20 in a conventional press-fit operation. The tip geometries 42, 42' described above provide advantages during the press-fit operation. Because the tip-to-body corners 52, 52' and the tip-to-body edges 48, 48' are relieved, there is a reduced tendency for the tips 42, 42' to skive plastic out of the body 12 as the tips 42, 42' pass through the through hole 20. Because of the cooperation between the shape of the posts 30 and the shape of the through holes 20, maximum stresses on the body 12 around the through holes 20 are reduced, and maximum insertion forces are reduced as well. Furthermore, because the mating end 54 is shaped as described above, mating forces are reduced as well.

Figure 13:
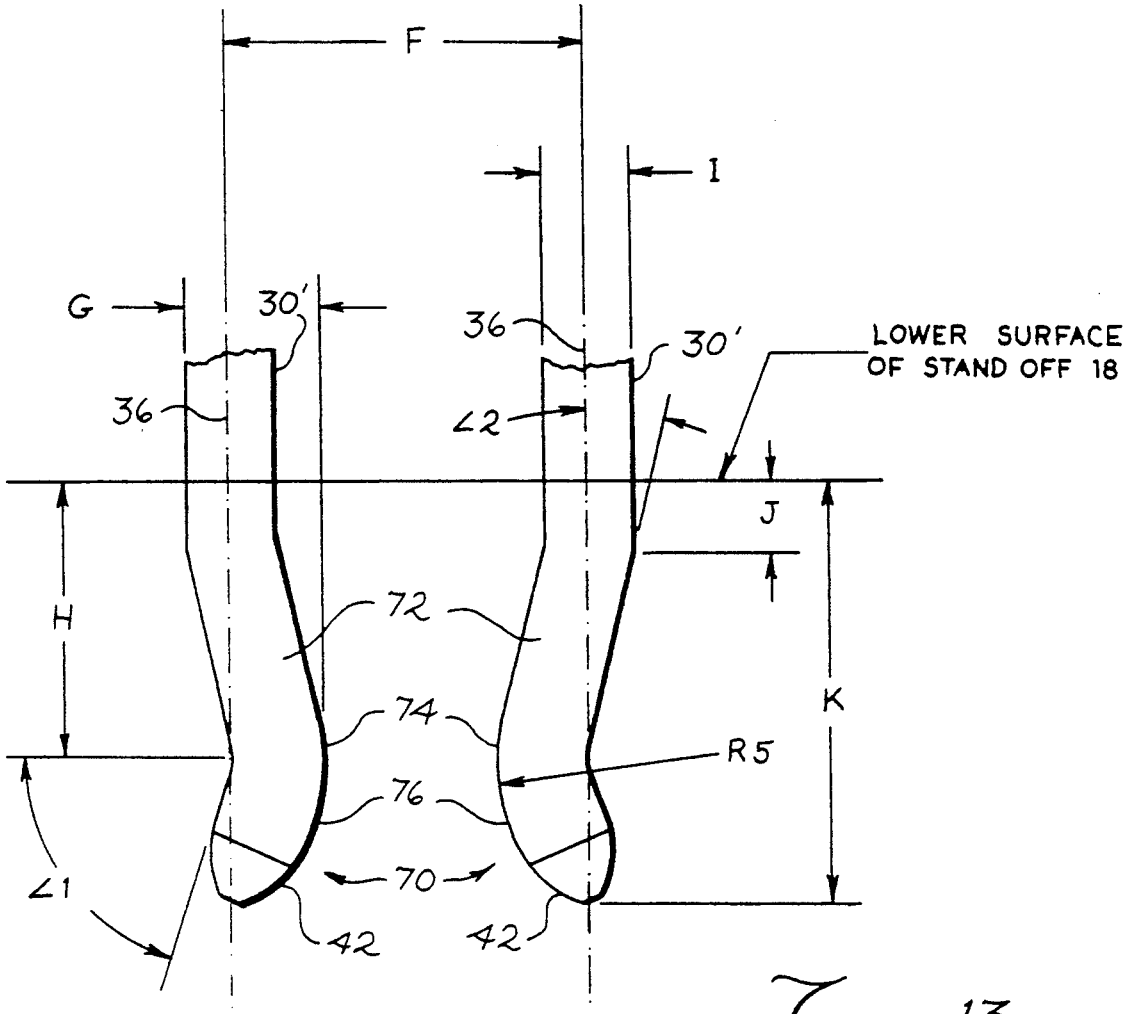
FIG. 13 is an end view showing the configuration of the posts at one of the ends of the connector of FIG. 1.
Figure 14:
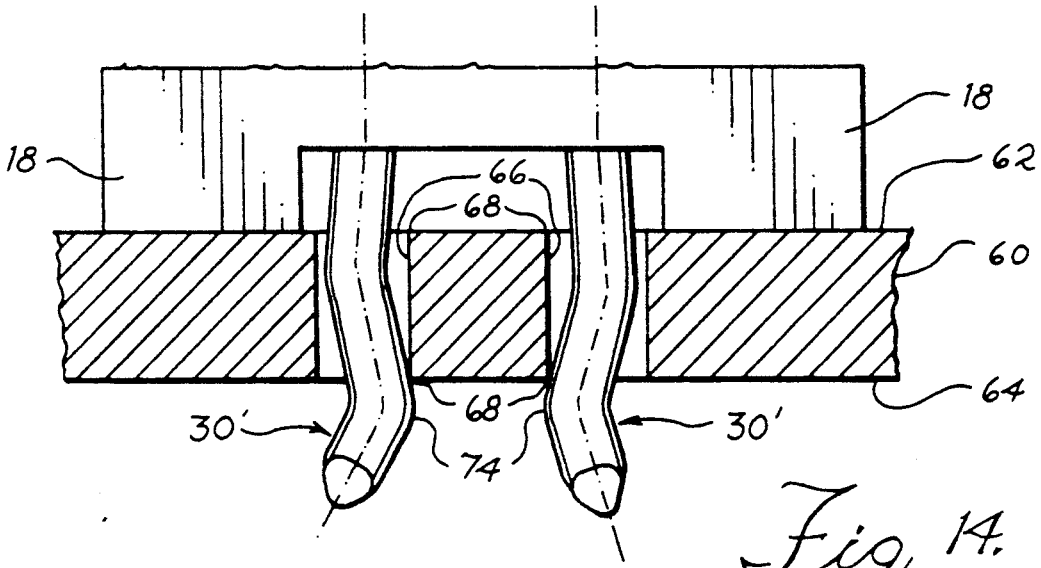
FIG. 14 is a cross sectional view showing the posts of FIG. 14 engaged with a printed circuit board prior to soldering.

Once the electrical connector 10 has been assembled by press fitting the posts 30 into the body 12, a retention feature can be added to selected ones of the posts 30 to retain the electrical connector 10 temporarily in place in a circuit board prior to soldering. FIG. 13 shows an enlarged end view of the connector 10 and two of the corner posts 30'. FIG. 14 shows a cross-sectional view of the electrical connector 10 mounted in a circuit board 60 prior to soldering. The circuit board 60 defines top and bottom surfaces 62, 64 and through holes 66 extending therebetween. The through holes 66 are generally cylindrical, and the intersection region between the through holes 66 and the surfaces 62, 64 defines corners 68.

Figure 12:
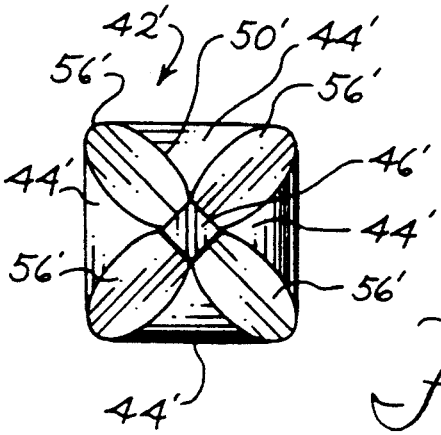
FIG. 12 is an end view of the tip of FIG. 11.

As shown in FIG. 13, at least one and preferably pairs of the posts 30' are bent to provide a retention feature 70. The bent portion of each of the posts 30' defines a first portion 72 which diverges away from the centerline 36 to an apex 74. The bent post also defines a second portion 76 which extends from the apex 74 to the tip 42. As shown in FIG. 12, the first and second portions 72, 76 are configured such that the apex 74 is positioned to one side of the centerline 36, but the tip 42 is positioned on the centerline 36. When the connector 10 is installed on the circuit board 60 (FIG. 14), the apexes 74 are positioned below the bottom surface 64. In this way, each of the retention features 70 creates a latching force tending to pull the electrical connector 10 into contact with the top surface 62.

Because the retention features 70 function below the board to latch the electrical connector 10 in place, an audible click may be heard when the electrical connector 10 is seated on the circuit board 60. Some users regard this latching type retention feature as more stable than retention features which rely solely on friction within the through hole 66. The retention feature 70 has surprisingly been found to function properly with circuit board through holes 66 having a wide range of diameters, without unacceptable damage to the tin plating that is typically present in the through hole. This surprising result is believed to be directly attributable to the cooperation between the geometry of the first and second portions 72, 76 and the geometry of the radiused post edges 40. The resulting retention feature reduces damage to the through hole plating and functions without any undesirable increase in the length of the post 30' extending below the bottom surface 64 of the circuit board 60.

The retention feature 70 can be used both with straight headers as shown and right angle headers (not shown). Furthermore, the retention feature 70 can be used on single posts or on pairs of posts as shown in which the apex is 74 offset with respect to the centerline 36. Depending upon the application, the apexes 74 may be offset toward one another, away from one another, or at some angle with respect to one another. Furthermore, the retention feature 70 is well suited for use in headers having one, two, or three or more rows of posts 30.

Simply by way of example, the following details of construction have been found suitable in one application. Of course, these details are not intended to limit the scope of this invention, because other applications will often require other specific geometries or materials. With respect to materials, the posts 30, 30' may be formed from drawn, radiused phosphor bronze wire such as UNS C51000, Temper 3H. The body 12 may be molded of any suitable material such as a glass filled nylon or a liquid crystal polymer.

With respect to dimensions, Table 1 provides presently preferred dimensions, using reference symbols defined in FIGS. 5, 6, 8 and 13.

TABLE 1

| Reference Symbol (Figures) | Dimension (inches) Or Angle (degrees) |
|---|---|
| A | 0.023 |
| B | 0.018 |
| C | 0.0095 |
| D | 0.0245 |
| E | 0.0245 |
| F | 0.100 |
| G | 0.038 |
| H | 0.077 |
| I | 0.0245 |
| J | 0.020 |
| K | 0.117 |
| $L_1$ | 70° 46' |
| $L_2$ | 13° 35' |
| $R_1$ | 0.130 |
| $R_2$ | 0.007 |
| $R_3$ | 0.037 |
| $R_4$ | 0.006 |
| $R_5$ | 0.055 |

The round portion 22 in this preferred embodiment has a diameter of 0.0277 inches, and the out-of-round portion 24 in this preferred embodiment defines a maximum diagonal dimension of 0.0277 inches, and a maximum dimension between opposed faces 26 of 0.0235 inches. The posts 30, 30' define a maximum diagonal dimension of 0.0292 inches. These dimensions have been found to provide excellent post retention without excessive post insertion forces or excessive stresses to the body 12.

Figure 8:
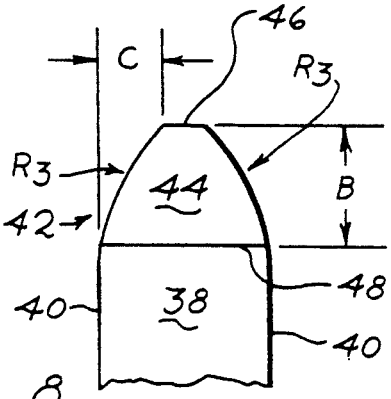
FIG. 8 is an enlarged view of the encircled region 8 of FIG. 7.

Preferably, the tip 42 is formed in a multi-step operation which combines coining and shearing operations, using vertically moving dies. In the first step an upper one of the tip faces 44 is coined downwardly. This pushes excess metal laterally. Then the two side tip faces 44 shown in profile in FIG. 5 are sheared into the desired convex shape. Finally, the upper and lower tip faces shown in profile in FIG. 8 are coined (the upper tip face for the second time and the lower tip face for the first time) to the final convex shape. This approach provides the desired tip geometry while requiring only dies that move vertically.

The first ends 32 are typically tin plated to facilitate soldering, and the second ends 34 are typically gold plated to facilitate mating operations. However, plating details for the first and second ends do not form part of this invention, and are therefore not described in greater detail here.

This preferred embodiment has been designed for use with through holes 66 having a diameter of 0.040±0.003 inches in a circuit board 60 having a thickness of 0.062 ±0.007 inches. Throughout these tolerance ranges the connector 10 can be inserted with an insertion force of no more than 10 pounds, and adequate retention forces are obtained. Surprisingly, this has been achieved with stiff posts of the type described above, without damage to the tin plating at the corners 68.

The present invention may readily be adapted to square posts of other dimensions and to rectangular posts. Other forming techniques such as rolling and cutting operations may be used to form the tip, and the radiused post edges may be compressively or otherwise formed only in desired regions of the post.

We claim:

1. In an electrical connector of the type comprising a connector body and at least one post extending out of at least one side of the connector body, wherein the post defines a tip, wherein the post defines two pairs of opposed post faces that intersect at edges extending along the post, and wherein the post defines a maximum face to face dimension between two of the opposed post faces, the improvement comprising:

four tip faces which converge toward a tip nose, each tip facing being aligned with a respective one of the post faces and intersecting therewith at a selected axial location, adjacent ones of the tip faces meeting at protruding tip edges, each tip edge being associated with a respective edge of the post;

wherein at least one of the tip faces is convex outwardly;

wherein the edges between the post faces adjacent the tip are curved with a radius of curvature greater than about one-fifth the maximum face to face dimension, and wherein the tip edges and adjacent tip faces intersect with respective associated curved edges of the post forwardly of the selected axial location at transition corners of reduced protrusion to minimize skiving during hole insertion of the tip nose.

2. The invention of claim 1 wherein the opposed post faces in each pair are separated by an equal distance.

3. The invention of claim 2 wherein opposed post faces in each pair are separated by about 0.025 inches, and wherein the radius of curvature is greater than about 0.005 inches.

4. The invention of claim 3. wherein the tip faces are each convexly curved with a radius of curvature greater than the maximum face to face dimension.

5. The invention of claim 4, wherein the edges between the post faces are curved with a radius of curvature of about 0.006 inches.

6. The invention of claim 1 wherein the tip defines a length, and wherein the length is less than the maximum face to face dimension.

7. The invention of claim 6 wherein the opposed post faces in each pair are separated by about 0.025 inches, and wherein the radius of curvature is greater than about 0.005 inches.

8. The invention of claim 1 wherein the post defines a mating end, opposed to the tip, for interconnection with a mating connector, and wherein the mating end defines four additional tip faces which converge toward the mating end, each additional tip face aligned with a respective one of the post faces, at least one additional tip face convex outwardly, each of the edges between the post faces adjacent the mating end curved with a radius of curvature greater than about one-fifth the maximum face to face dimension.

9. The invention of claim 1 wherein the connector body defines preformed through holes which receive the posts, wherein the preformed through holes define two portions of different cross-sectional dimensions, and wherein the preformed through holes are free of internal mating lines.

10. The invention of claim 1 wherein said tip faces define a substantially rectangular cross sectional shape.

11. A method of assembly an electrical connector comprising the following steps:

a) providing a connector body which defines a plurality of preformed through holes;

b) providing a plurality of posts, each defining two pairs of opposed post faces and a tip at one end thereof, adjacent post faces intersecting at edges extending along the post, each of the tips defining four tip faces which converge toward a tip nose, each tip face being aligned with a respective one of the post faces and intersecting therewith at a selected axial location, adjacent ones of the tip faces meeting at protruding tip edges, each tip edge being associated with a respective edge of the post, each of the tip faces having an outwardly convex shape, each of the edges between the post faces adjacent the tip having a radius of curvature greater than about one-fifth of a maximum face to face dimension between two of the opposed post faces, wherein the tip edges and adjacent tip faces intersect with respective associated curved edges of the post forwardly of the selected axial location at transition corners of reduced protrusion; and c) press fitting the posts in the through holes of the connector body by passing the tips through the through holes, said transition corners operative to reduce skiving of the connector body by the posts during hole insertion of the tip noses.

12. The method of claim 11 wherein the tip faces of the posts provided in step (b) define a substantially rectangular cross sectional shape.

* * * * *